US007077488B2

(12) United States Patent
Wiklund et al.

(10) Patent No.: US 7,077,488 B2
(45) Date of Patent: Jul. 18, 2006

(54) DRAWER CLOSING MECHANISM

(75) Inventors: Ken Wiklund, Kewlona (CA); Todd Booker, Garner, NC (US); Georg Domenig, Kernersville, NC (US)

(73) Assignee: Grass America Inc., Kernersville, NC (US)

( * ) Notice: Subject to any disclaimer, the term of this patent is extended or adjusted under 35 U.S.C. 154(b) by 154 days.

(21) Appl. No.: 10/844,890

(22) Filed: May 13, 2004

(65) Prior Publication Data

US 2005/0001523 A1 Jan. 6, 2005

Related U.S. Application Data

(60) Provisional application No. 60/470,054, filed on May 13, 2003, provisional application No. 60/527,596, filed on Dec. 5, 2003.

(51) Int. Cl.
*A47B 88/00* (2006.01)

(52) U.S. Cl. ..... 312/333; 312/319.1

(58) Field of Classification Search ..... 312/333, 312/334.44, 334.45, 334.46, 319.1; 384/20–21; 16/64

See application file for complete search history.

(56) References Cited

U.S. PATENT DOCUMENTS

| | | | | |
|---|---|---|---|---|
| 588,564 | A * | 8/1897 | Friesen | 30/80 |
| 3,658,398 | A | 4/1972 | Abbate, Jr. et al. | |
| 3,836,222 | A | 9/1974 | Kuntze | |
| 4,428,307 | A | 1/1984 | Vasquez | |
| 4,436,989 | A | 3/1984 | Schuldt | |
| 4,660,881 | A | 4/1987 | Komeya et al. | |
| 4,828,344 | A | 5/1989 | Omata | |
| 5,015,048 | A | 5/1991 | Brunnert | |
| 5,135,294 | A * | 8/1992 | Ohshima et al. | 312/334.46 |
| 5,143,432 | A | 9/1992 | Ohshima et al. | |
| 5,364,179 | A | 11/1994 | Brustle et al. | |
| 5,377,062 | A | 12/1994 | Gielkens et al. | |
| 5,492,400 | A * | 2/1996 | Rock | 312/331 |
| 5,564,807 | A | 10/1996 | Rock et al. | |
| 6,039,421 | A | 3/2000 | Fulterer | |
| 6,473,936 | B1 * | 11/2002 | Orita | 16/82 |
| 6,499,818 | B1 | 12/2002 | Brustle | |
| 6,666,306 | B1 * | 12/2003 | Gasser | 16/64 |
| 6,848,759 | B1 * | 2/2005 | Doornbos et al. | 312/333 |

FOREIGN PATENT DOCUMENTS

| | | | | |
|---|---|---|---|---|
| EP | 0 391 221 B1 | | 9/1995 | |
| JP | 06189832 | * | 7/1994 | 312/333 |
| WO | WO 2004/023933 A1 | | 3/2004 | |

OTHER PUBLICATIONS

International Search Report mailed Aug. 10, 2004 corresponding to PCT/US04/14989.

* cited by examiner

*Primary Examiner*—Lanna Mai
*Assistant Examiner*—Hanh V. Tran
(74) *Attorney, Agent, or Firm*—John M. Harrington; Kilpatrick Stockton LLP

(57) ABSTRACT

A drawer closing mechanism includes a toothed rack fixed in position with respect to a furniture frame member, a toothed drive gear mounted to a drawer for engaging the teeth on the rack, and a spring with two ends, one end being fixedly attached to the drive gear and rotatable therewith and the opposite end being fixed, wherein as the drawer is pulled open, the teeth on the drive gear engage the teeth on the rack and rotate the drive gear, and as the drive gear rotates, the spring is wound and potential energy is stored in the tension therein. The spring can be a flat wire spring wound circumferentially about a central point in a spiral.

8 Claims, 3 Drawing Sheets

DRAWER CLOSING MECHANISM

CROSS-REFERENCE TO RELATED APPLICATIONS

This application claims priority to U.S. Provisional Application No. 60/470,054, filed May 13, 2003, entitled "Drawer Closing Mechanism", and U.S. Provisional Application No. 60/527,596, filed Dec. 5, 2003, entitled "Drawer Closing Mechanism With Drive Belt".

FIELD OF THE INVENTION

The present invention relates to a mechanism for automatically closing a drawer. More particularly the present invention relates to a spring loaded, tooth and gear mechanism that uses tension created in the spring when the drawer opens to pull the drawer closed.

BACKGROUND OF THE INVENTION

There have been several attempts in the prior art to provide a self closing drawer system. One early attempt is demonstrated in U.S. Pat. No. 3,658,398, which shows the guide rails of the drawer slanted from the front to the back of the inside of the cabinet. In the open position, the drawers are held in place by a latch mechanism. When the latch mechanism is disengaged, the drawer slides down the inclined guide rails into a closed position.

One disadvantage of this system is that when the drawers are pushed back into the cabinet, they are pulled, pushed and/or accelerated by the diagonally installed slides. The closing force is proportional to the force of gravity and thus the weight of the drawer and its contents. If the contents of the drawer are heavy, the closing drawer sill accelerate rapidly, with too much momentum, and slam into the cabinet possibly damaging the drawer, its contents, the cabinet, or some combination thereof.

The European patent application EP 0 391 221 A1 shows a closing device for drawers, which pulls the drawer over a longer distance in the cabinet, but only in the final third section of the drawer's draw-pull length. If the drawer is opened, a tilting segment moves along a guide groove stressing a helical/coil spring, which is fastened at the one end to the tilting segment and at the other end to the cabinet. After a certain pull-out opening distance, the first third of the maximum pull-out distance, the tilting segment is released from the drawer and locks in an elbow of the guide groove at the place where the drawer's uncoupling takes place. The drawer is then free to move and open without pulling or pushing effects from a spring. If the drawer is closed, the drawer and/or its drawer rail in the last third of the insertion distance couples due to the spring's stressed condition and the clamped tilting segment at the place where the coupling takes place in the guide groove, which is disengaged by a light push of the drawer. Thus, the tilting segment can be pulled into the guide groove in the cabinet by the pre-loaded strength of the spring, which pulls the coupled drawer into the closed position. Therefore, the closing device operates maximally and effectively only in the final third of the drawer's closing length.

This closing device that only operates in the final third of the drawer slide has the disadvantage that the drawer must be manually pushed the majority of the way down the drawer slide before the self-closing force activates.

It is, therefore, desirable to provide a closing device which closes a drawer no matter how far it is open and is engageable from any partially open position at which the drawer is stopped. This will overcome the prior art disadvantages of manually pushing the drawer closed until the closing device actuates, or having to manually secure the drawer in an open position while accessing the items within.

Further, it is desirable to provide a closing device that can be mounted in a standard drawer design without the need to significantly redesign the associated drawer slides and other hardware.

Further desirable is a drawer closing mechanism which does not have large exposed springs or other mechanisms which could catch items stored below the drawer in adjacent cabinet space.

SUMMARY OF THE INVENTION

The present invention solves the problems seen in the prior art by winding a spring to store potential energy therein during the drawer's opening cycle along the total pull-out length. A stop mechanism is provided to hold the door in an open position, and after the stopper is released, the spring is allowed to release the potential energy stored therein to give a controlled, slow and uniform pull-back along the entire closing distance in the form of kinetic energy.

In a first aspect of the present invention, a drawer closing mechanism is provided comprising a rack fixed in position with respect to a furniture frame member and comprising a plurality of teeth a drive gear mounted to a drawer and comprising a plurality of teeth for engaging the teeth on the rack, and a spring with two ends, one end fixedly attached to said drive gear and rotatable therewith and the opposite end fixed, wherein as the drawer is pulled open, the teeth on the drive gear engage the teeth on the rack and rotate the drive gear, and as the drive gear rotates, the spring is wound and potential energy is stored in the tension therein. The drawer slide is mounted to the furniture frame member, and the rack is mounted to the drawer slide. In a preferred embodiment of the present invention, the spring comprises a flat wire spring wound circumferentially about a central point in a spiral.

In one embodiment of the present invention, the drawer closing mechanism further comprising stop means for retaining the drawer in an open position. In a preferred embodiment of the present invention, the stop means comprises a roller housed in a case comprising two chambers, in the first chamber the roller is allowed to rotate freely, in the second chamber the roller is prevented from rotating, and said roller is moveable between the two chambers by exerting an inward force on the drawer.

In an additional embodiment of the present invention, the drive gear and spring are positioned toward the rear of the drawer such that the teeth on the drive gear remain engaged with the rack at all points along the drawers path from a fully closed position to a fully open position.

In a further embodiment of the present invention, the drawer closing mechanism further comprises a transfer gear positioned between the drive gear and the rack and comprising teeth thereon. The teeth on the drive gear engage the teeth on the transfer gear and the teeth on the transfer gear engage the teeth on the rack.

In an alternate embodiment of the present invention, the drive gear is connected to the transfer gear through a pulley and drive belt system. The transfer gear is then optionally positioned at the rear of the drawer to engage the teeth on the rack. Additionally a housing may be provided mounted to the drawer, and said drive gear and spring are housed therein.

As will be realized by those of skill in the art, many different embodiments of a drawer closing mechanism according to the present invention are possible. Additional uses, objects, advantages, and novel features of the invention are set forth in the detailed description that follows and will become more apparent to those skilled in the art upon examination of the following or by practice of the invention.

DETAILED DESCRIPTION

Figure 1:
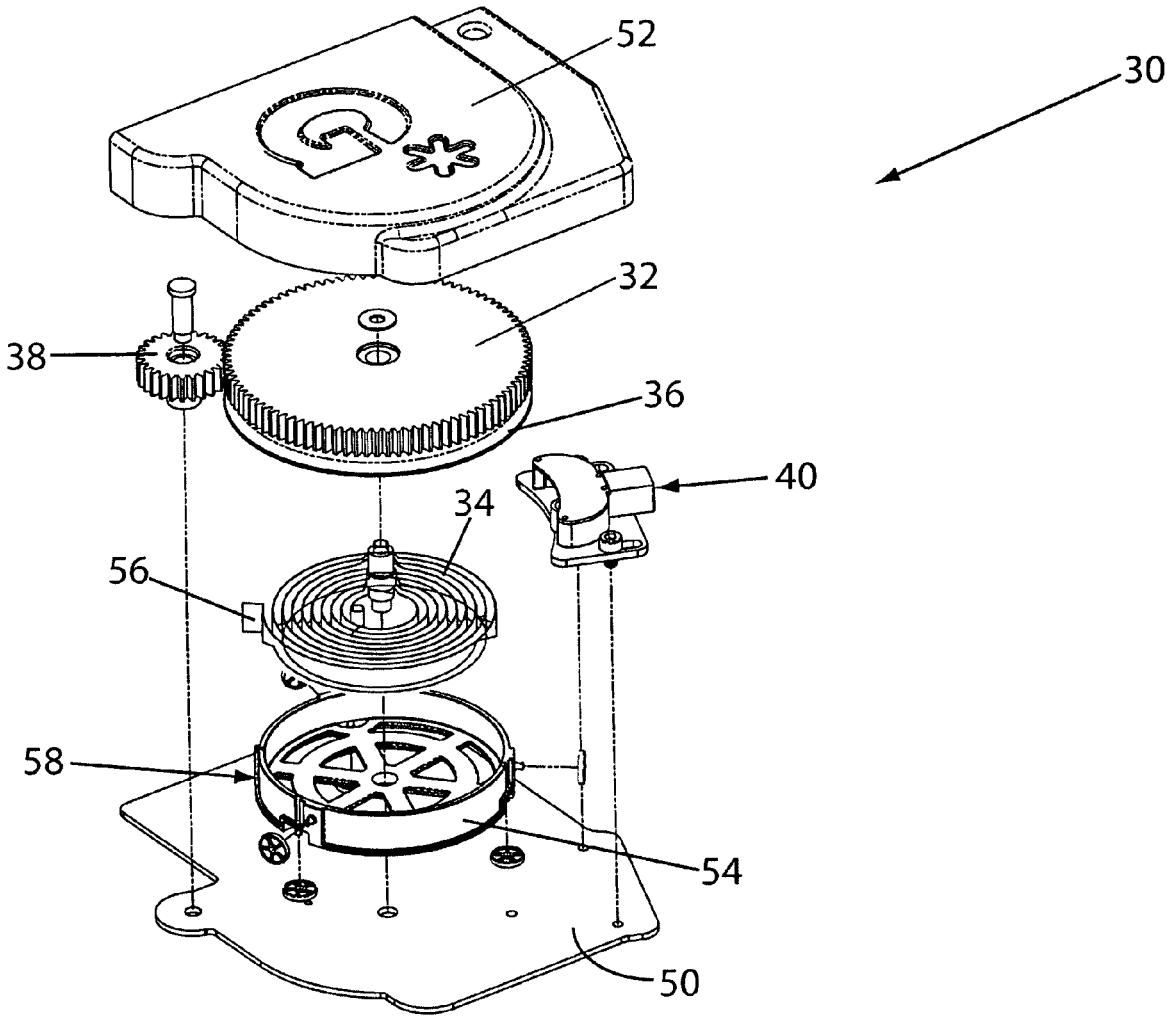
FIG. 1 is a perspective view of the drawer closing mechanism of an embodiment of the present invention.

In a first aspect of the present invention, a drawer closing mechanism is provided comprising a rack fixedly mounted relative to a drawer frame member and comprising a plurality of teeth thereon, a drive gear comprising teeth for engaging the teeth on the rack, and a spring means. The drive gear and spring are mounted to the underside of a drawer such that the teeth on the drive gear engage the teeth on the rack. As the drawer is pulled open, the engaging teeth cause the drive gear to rotate which in turn rotates one end of the spring causing it to wind. As the spring winds, potential energy is stored in the tension in the spring. When the drawer is subsequently released, the tension in the spring causes the drive gear to rotate in an opposite direction, which, through the engagement between the teeth on the drive gear and the teeth on the rack, pulls the drawer from an opened position to a closed position.

In a first embodiment of the present invention the drawer closing device is mounted and incorporated into a drawer slide system. This system comprises at least one drawer slide member 24 fixedly mounted to the furniture frame. A second drawer slide 26 is fixedly mounted to the underside of a drawer. A set of rollers is provided between the two drawer slides to provide a low-friction contact between the drawer slide members which allows the second drawer slide member 26 to move relative to the fixed drawer slide member 24.

In another embodiment of the present invention, additional drawer slide members are provided as is known in the art. The drawer closing mechanism of the present invention is operable with multiple drawer slide configurations with slight modifications, which will be apparent to one skilled in the art.

Fixedly attached to the fixed drawer slide member 24 is a rack 20 comprising a plurality of teeth 22 thereon. The depth and spacing of the teeth will vary based on the weight and size requirements of the drawer closing mechanism. In a preferred embodiment of the present invention the teeth 22 are provided on the rack 20 at a rate of about 12 teeth per inch. The rack is preferably made from stainless steel to provide strength and durability to the teeth.

In one embodiment of the present invention, the rack is integrally designed into the fixed drawer slide member 24. When the drawer slide member 24 is fabricated, a set of teeth 22 is constructed along a leading edge. In this manner the fixed drawer slide member 24 and the rack 20 comprise a single unit.

Figure 2:
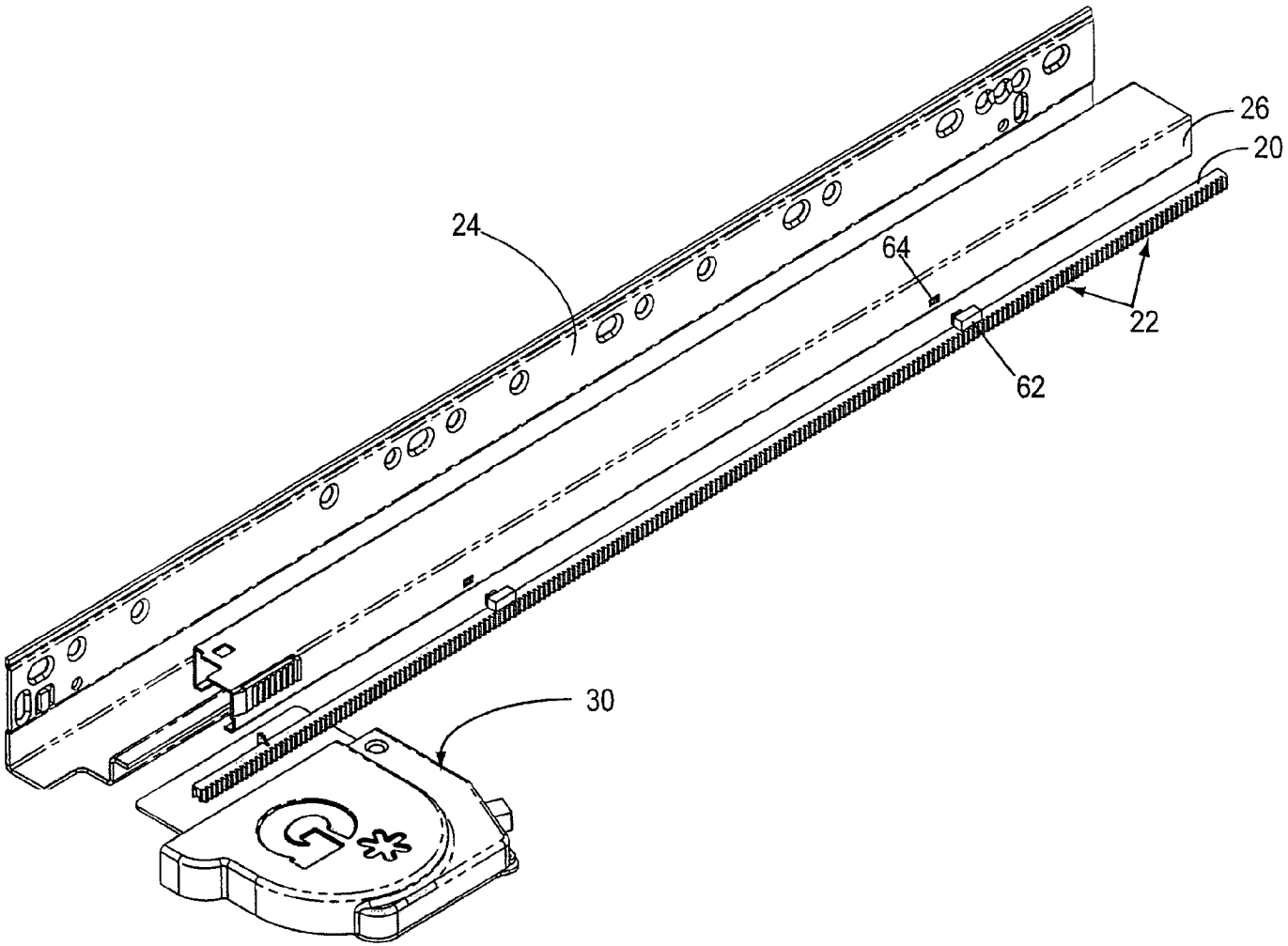
FIG. 2 is an exploded view of the spring and gear mechanism of an embodiment of the present invention.
Figure 3A:
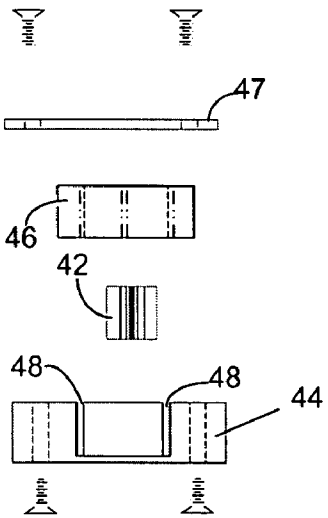
FIG. 3*a* is an exploded view of the brake mechanism of an embodiment of the present invention.
Figure 3B:
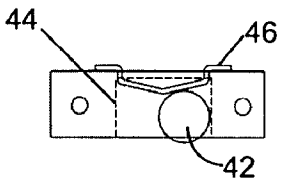
FIG. 3*b* is a top view of the brake mechanism of an embodiment of the present invention.
Figure 3C:
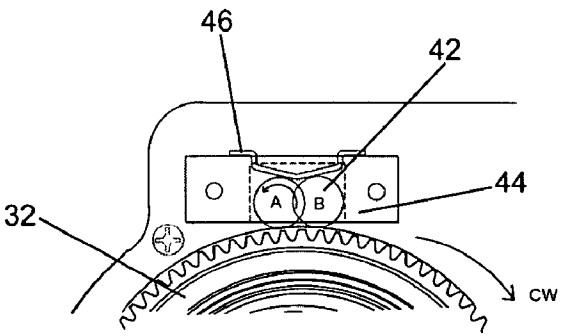
FIG. 3*c* is a top view of the brake mechanism engaged to the drive gear in an embodiment of the present invention.

In a further additional embodiment of the present invention shown in FIG. 2, the locations of the auto close mechanism 30 and the rack 20 are transposed. In this embodiment the rack is mounted on the drawer, or on the drawer slide member 26 as illustrated in FIG. 2, which in turn is mounted on the drawer. The auto close mechanism 30 including the drive gear 32, spring 34, and stop means 40 are mounted directly to the furniture frame or the fixed drawer slide member 24 as illustrated in FIG. 2. In a preferred embodiment of the present invention, the auto close mechanism 30 is located toward the front of the furniture frame, however, positioning may be determined based on the overall design of the unit.

In a preferred embodiment of the present invention, the rack 20 is manufactured as a separate component from the fixed drawer slide member 24. The rack 20 is then fixedly attached to the drawer slide member 26 through hooks, clasps, bolts, screws or the like. In a preferred embodiment of the present invention shown in FIG. 2, the rack 20 is attached to the drawer slide member 26 through a snap-on means by providing a tongue and groove slide-lock configuration between protrusions 62 on the rack 20 and receiving apertures 64 in the drawer slide member 26.

In a further embodiment of the present invention, in an assembled position, the rack 22 extends substantially the entire length of the fixed drawer slide member 24 to allow a full extension of the drawer slide and a maximum range of motion between the drawer and the furniture cabinet. In a preferred embodiment of the present invention, the drive gear and spring are positioned toward the rear portion of the drawer. In this position the teeth on the drive gear are able to engage the teeth on the rack throughout the entire length of the rack from a fully closed position to a fully opened position of the drawer.

The drive gear 32 is fixedly attached to the drawer and comprises a plurality of teeth on its circumference which engage the teeth 22 of the rack 20. In this manner the drive gear 32 moves along the rack 20 by rotation and engaging successive teeth on the rack 20. The tooth on tooth configuration of the drive gear and rack provides a high friction engagement between the drawer and the fixed drawer slide member, which allows the drawer to move relative to the drawer slide member while remaining firmly engaged thereto.

In a preferred embodiment of the present invention a large drive gear 32 is provided. Preferably, the drive gear is capable of moving from one end of the rack 20 to the other with a minimum number of rotations. In a most preferred embodiment the drive gear rotates between about 2 and about 3 times during a travel down the full length of the rack. This can be accomplished by providing about 100 teeth on the drive gear to correspond to the roughly 12 teeth per inch on the rack. An advantage of a larger drive gear is the tension stored in the spring 34 during the extension of the drawer.

A spring is provided to store tension and provide the energy needed to pull the drawer closed when so desired. In a preferred embodiment of the present invention, the spring comprises a coil of stainless steel flat wire that is wrapped circumferentially about a center portion. One end of the spring is fixedly attached to the drawer and the opposite end is fixedly attached to the rotating drive gear. In a preferred embodiment of the present invention, the spring 34 is contained within a housing 54. One end of the spring 34 comprises an outturned tab 56 that is inserted into a corresponding slot 58 in the spring housing 54. In this manner the outer end of the spring is retained while the inner end is wound through its engagement with the drive gear 32.

As the drive gear rotates during its journey down the rack, it winds the spring storing energy therein. Once the drive gear is fully extended, there is a maximum energy stored in the spring which will provide a closing force to the drive gear causing it to rotate in a direction opposite to the winding direction and move back down the rack pulling the drawer closed with it.

In this manner, the spring 34 is wound proportionally to the extent to which the drawer is opened. For example, if the drawer is opened half way, the drive gear has traveled half way down the rack, and the spring has stored the equivalent energy necessary to pull the drawer closed.

The strength of the spring may be varied by choosing the stiffness of the spring material and adjusting the number and degree of revolutions of the spring coil. In a preferred embodiment o the present invention, the spring is coiled about 9 to 10 times. However, one skilled in the art will recognize this number can vary. For example, if a heavier drawer, or heavier drawer load, is anticipated, a stiffer spring will be desired to provided additional force for the closing action.

In a further embodiment of the present invention, a transfer gear 38 is provided to engage both the drive gear 32 and the rack 20. In this manner, the transfer gear 38 provides a means for engaging the drive gear 32 and the rack 20 without the two components physically touching. This design is preferred to provide space between the drive gear 32 and the edge of the drawer and/or the rack 20. If the drive gear 32 and the rack are in close proximity, it becomes more difficult to integrate additional components into the drawer closing mechanism. Thus, by providing a transfer gear 38, spacing roughly equivalent to the diameter of the transfer gear is provided.

The size and number of teeth on the transfer gear will vary depending on the space requirements of the mechanism's design.

As described above, the drawer closing mechanism operates by storing tension in a spring which is wound by pulling the drawer into an open or extended position. In an additional embodiment of the present invention, a stop means is provided to retain the drawer in an open position against the tension in the spring. Preferably, the stop means also comprises a means for releasing the drawer such that the spring is allowed to relax and pull the drawer into a closed position.

In a preferred embodiment of the present invention, the stop means comprises a braking mechanism 40 comprising a roller 42 housed in a case 44. The case 44 comprises two regions defined by a spring 46 at the rear of the case. The spring is angled vertically in the center to form the two regions. Preferably, the spring 46 comprises a metal spring which is bent in the middle and extends through the rear of the case 44 or is compressed within the case 44 such that it is held in place against the side of the case 44. An O-ring 36 is provided in combination with the drive gear 32. The O-ring 36 comprises a diameter slightly larger than the diameter of the drive gear 32 such that it extends from the side of the drive gear and contacts the roller 42. By providing the angled spring 46 the region of the case 44 are dimensioned such that the outer sides provide a larger area for the roller than the inner sides. In this manner when the roller 42 is pushed toward the outer sides, it may rotate freely. When it is pushed toward the inner sides, and toward the center of the spring, it is restricted from rolling freely between the contact of the O-ring 36 and the spring 46. The spring 46 is designed such that the force being applied by the spring 34 is insufficient to move the roller 42 into the opposite region. However, a gentle push on the outside of the drawer will provided the additional force needed to push the roller 42 into the opposite chamber where it can then rotate freely.

In this manner, for example, as the drawer is extended, the drive gear rotates in a counter-clockwise direction and the roller resides in position A. The counter-clockwise motion of the drive gear keeps the roller toward the outer side of position A, and it is allowed to rotate freely. When the drawer is released, the force of the spring 34 attempts to rotate the drive gear 32 in a clockwise direction. Thus, the roller 42 is forced toward the center of the case 44 where the roller 42 is wedged between the spring 46 and the gear 32 (position A). This will stop the rotation of the gear and retain it against the force of the spring. When additional force is applied, enough to push the roller 42 past the midpoint of the spring 46, the spring 46 will deflect and allow the roller to pass to the other region of the case 44. In this position (position B) the roller is allowed to rotate freely in the clockwise direction.

In a further embodiment of the present invention, a housing is provided to secure the components of the auto close mechanism 30 to the drawer. Rather than mounting the mechanism components 30 onto the drawer itself, a case is provided to protect both the mechanism 30 and the surrounding environment. Anything below the drawer is susceptible to getting caught in the gear and tooth mechanism unless adequate protective measures are employed. In one embodiment of the present invention, the case comprises a support plate 50 to which the spring case 54 is mounted. The spring 34 is housed within the spring case 54 and the drive gear 32 and O-ring 36 are affixed thereto. The support plate 50 also provides a surface for mounting the breaking mechanisms 40 and transfer gear 38.

In an additional embodiment of the present invention, a dual drawer closing device is provided comprising two sets of racks, drive gears, and springs, each set mounted on either side of a drawer. In this embodiment both the right and left sides of the drawer have closing mechanisms. This may be preferable, for example, for use with an exceptionally heavy or exceptionally large drawer, where one closing mechanism would struggle under the weight.

In a further embodiment of the present invention, the drive gear 32 and the transfer gear 38 are not in direct communication with one another, but rather are mechanically linked through a drive belt. In a preferred embodiment of the present invention described above, the auto close mechanism 30 is positioned toward the rear of the drawer. If it is desirous to place the auto close mechanism 30 in a position in the center of the drawer or near the front of the drawer, the transfer gear is then mounted at the rear of the drawer to contact the rack 20, and a belt connects the transfer gear in rotational arrangement with the drive gear.

In a still further embodiment of the present invention, a single auto close mechanism 30 may be used to drive two transfer gears 38 engaging two racks 20 on the drawer slide members on either side of the drawer. In this manner the single spring 34 and drive gear 32 store and subsequently transfer power to two transfer gears through two belts. The pulleys for engaging the drive gear to the belts are preferably stacked one on top of the other. An advantage to this embodiment over the two auto close mechanism embodiments described above is the necessity for only one set of spring 34, drive gear 32 and break means 40 which can operate two transfer pulleys thereby providing a savings in cost and materials.

In another embodiment of the present invention, the rack 20 and toothed gear 32 are replaced with a smooth running surface on the fixed drawer slide member 24 and a wheel in communication with the spring. In this embodiment, the drive gear 32 is replaced with a drive wheel which preferably has a high friction coating, such as rubber, on its circumference for contacting the smooth running surface of the fixed drawer slide. While the tooth and gear embodiment is preferred, it is within the scope of this invention to provide alternate means for transferring energy to and from the spring and propelling the drawer down the length of the fixed drawer slide member.

Although the present invention has been described with reference to particular embodiments, it should be recognized that these embodiments are merely illustrative of the principles of the present invention. Those of ordinary skill in the art will appreciate that the apparatus and methods of the present invention may be constructed and implemented in other ways and embodiments. Accordingly, the description herein should not be read as limiting the present invention, as other embodiments also fall within the scope of the present invention.

What is claimed is:

1. A drawer closing mechanism comprising:

a rack mountable in a fixed position with respect to a drawer and comprising a plurality of teeth;

a drive gear mountable to a furniture frame member or a fixed drawer slide member and comprising a plurality of teeth for engaging the teeth on the rack;

a spring with two ends, one end fixedly attached to said drive gear and rotatable therewith and the opposite end fixed;

wherein as the drawer is pulled open, the teeth on the drive gear engage the teeth on the rack and rotate the drive gear, and as the drive gear rotates, the spring is wound and potential energy is stored in the tension therein; and stop means for retaining the drawer in an open position, wherein the stop means comprises a roller housed in a case comprising two chambers, in the first chamber the roller is allowed to rotate freely thereby allowing opening of the drawer, in the second chamber the roller is prevented from rotating thereby retaining the drawer in the open position, and said roller is moveable between the two chambers by exerting a force on the drawer.

2. The drawer closing mechanism of claim 1, further comprising a movable drawer slide mountable to the drawer, and wherein the rack is mounted to said drawer slide.

3. The drawer closing mechanism of claim 1 wherein the spring comprises a flat wire spring wound circumferentially about a central point in a spiral.

4. The drawer closing mechanism of claim 1, wherein the drive gear and spring are positioned toward the rear of the fixed drawer slide member such that the teeth on the drive gear remain engaged with the rack at all points along the drawers path from a fully closed position to a fully open position.

5. The drawer closing mechanism of claim 1, further comprising a transfer gear positioned between the drive gear and the rack and comprising teeth thereon.

6. The drawer closing mechanism of claim 5, wherein the teeth on the drive gear engage the teeth on the transfer gear and the teeth on the transfer gear engage the teeth on the rack.

7. The drawer closing mechanism of claim 5, wherein the transfer gear is positioned at the rear of the fixed drawer slide member to engage the teeth on the rack.

8. The drawer closing mechanism of claim 1, further comprising a housing mounted to the fixed drawer slide member, and said drive gear and spring are housed therein.

* * * * *